US005088305A

United States Patent [19]

Myers

[11] Patent Number: 5,088,305

[45] Date of Patent: Feb. 18, 1992

[54] SNAP-IN SELF HOLDING DISC TUMBLER CONSTRUCTION

[75] Inventor: Gary L. Myers, River Grove, Ill.

[73] Assignee: Fort Lock Corporation, River Grove, Ill.

[21] Appl. No.: 670,564

[22] Filed: Mar. 18, 1991

[51] Int. Cl.[5] ..... E05B 29/04

[52] U.S. Cl. ..... 70/369; 70/375; 70/492

[58] Field of Search ..... 70/369, 375, 377, 384, 70/492

[56] References Cited

U.S. PATENT DOCUMENTS 4,057,987 11/1977 Patriquin ..... 70/492
4,398,405 8/1983 Patriquin ..... 70/369
4,416,129 11/1983 Thimot ..... 70/377 X
4,715,201 12/1987 Craig ..... 70/369
4,972,695 11/1990 Mochida et al. ..... 70/377 X

*Primary Examiner*—Renee S. Luebke
*Assistant Examiner*—Suzanne L. Dino
*Attorney, Agent, or Firm*—Leydig, Voit & Mayer

[57] ABSTRACT

An improved combinating tumbler lock including a lock plug having snap-in self holding combinating tumblers. The biasing spring first is inserted into a combinating tumbler slot in the plug. The combinating tumbler then is tilted and pressed into the slot compressing the spring longitudinally and laterally until the combinating tumbler retaining detent passes over the retaining edge in the opposite slot wall. The combinating tumbler then snaps into the slot, held in the operating position by the spring. The combinating tumbler can be removed by the opposite operation, when desired.

16 Claims, 2 Drawing Sheets

SNAP-IN SELF HOLDING DISC TUMBLER CONSTRUCTION

FIELD OF THE INVENTION

The present invention relates generally to a plug lock, and more particularly is directed to an improved removable snap-in self holding disc tumbler construction for plug locks.

BACKGROUND OF THE INVENTION

Conventional tumbler locks include a key-operated plug rotatably mounted in a cylindrical shell. The plug includes a plurality of combinating tumblers, typically disc tumblers, which are biased to extend into the shell to prevent rotation of the plug in the locked position. When a properly bitted key is inserted into the plug keyway, and hence through slots in the combinating tumbler, the combinating tumblers are retracted from the shell forming an unlocked position to allow the plug to rotate.

It often is necessary to replace the plug to change the keys which will operate the locks, for security purposes, such as changing tenants or employees. One type of removable plug is disclosed in U.S. Pat. No. 4,398,405 (3 405). The '405 patent allows the plugs to be removed from a lock and changed, however, the combinating tumbler construction is such that the combinating tumblers themselves are not removable. The combinating tumblers are force fit into the plugs during assembly of the plugs. Then the keys in the individual plugs are not changeable. Further, the force fitting of the combinating tumbler during assembly can cause burrs on the tumbler or plug and/or crimping of the combinating tumblers causing the plug to be inoperable or to fail during operation from breakage or jamming.

It thus would be desirable to provide a combinating tumbler plug, which does not require force fitting of the combinating tumblers during assembly and in which the combinating tumblers easily can be removed for replacement and to change keys which will operate the plug.

OBJECTS AND SUMMARY OF THE INVENTION

It is, therefore, a primary object of the present invention to provide an improved combinating tumbler lock plug with self holding snap-in combinating tumblers.

A further object of the present invention is to provide an improved combinating tumbler lock plug with removable combinating tumblers.

In general, the present invention contemplates a combinating tumbler lock plug having snap-in self holding combinating tumblers. In assembling the plug, the spring biasing the combinating tumbler is first inserted into the individual combinating tumbler slot. The combinating tumbler is dimensioned such that the combinating tumbler can be pressed into the combinating tumbler slot while compressing the spring both longitudinally and laterally against one slot side wall. This allows the combinating tumbler retaining detent to pass down the opposite side wall of the combinating tumbler slot from the spring and to snap into its retained position without burring of the combinating tumbler or slot and/or crimping of the detent. When it is desired to remove the plug to change keys, one or more of the individual combinating tumblers can be removed and replaced for the new key bitting.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Figure 1:
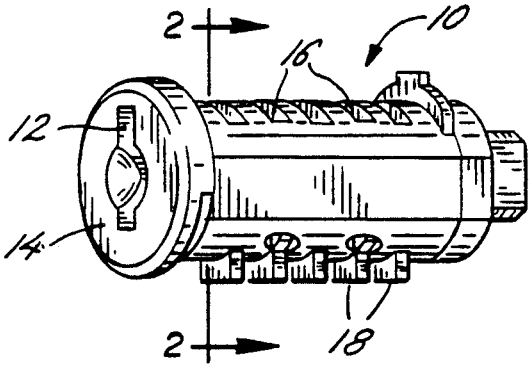
FIG. 1 is a perspective view of a lock plug in which the combinating tumbler of the present invention can be assembled.

Turning to the drawings, there is shown in FIG. 1 a combinating tumbler lock plug generally indicated by the reference numeral 10. The plug 10 would be inserted into a shell (not illustrated) to complete the lock. A key (also not illustrated) is inserted into a keyway 12 formed in an outer face 14 of the plug 10. The plug 10 includes a plurality of combinating tumbler slots 16 into which are inserted combinating tumblers 18, each configured to fit with a particular key bitting in a conventional manner.

Figure 2A:
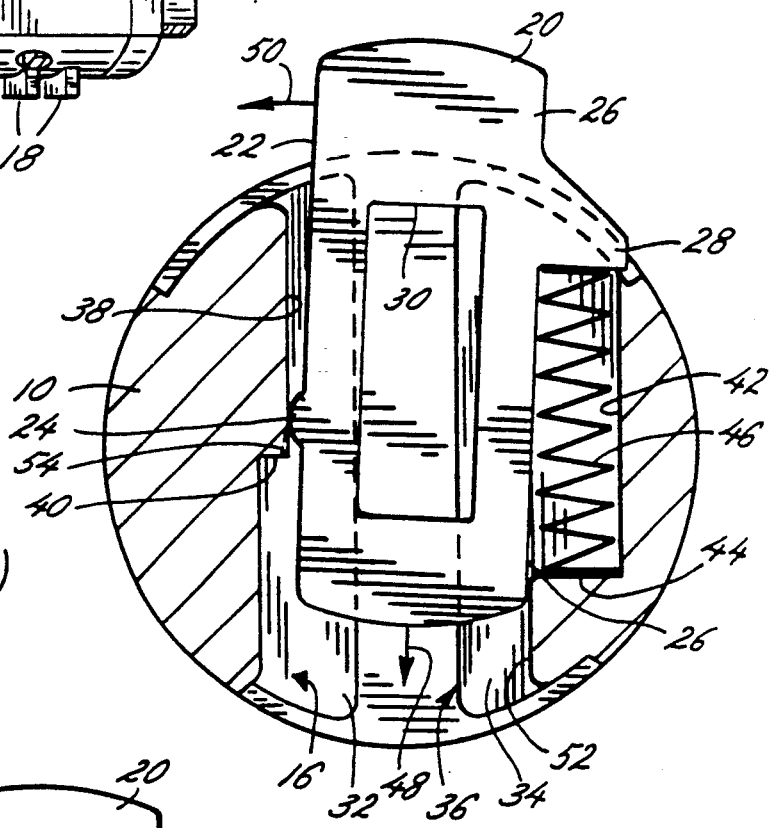
FIG. 2a (PRIOR ART)
FIGS. 2*a* and 2*b* are cross-sectional views of the prior art combinating tumbler assembly in the lock plug shown in and taken along the line 2—2 in FIG. 1.
Figure 2B:
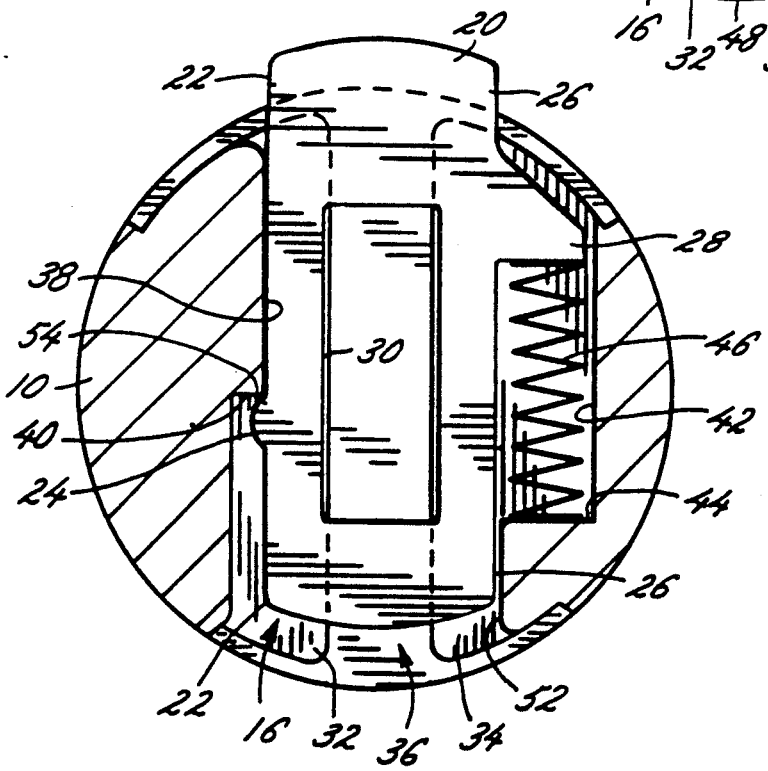
FIG. 2b (PRIOR ART)

Referring to FIGS. 2*a* and 2*b*, the assembly of a prior art combinating tumbler 20 is shown. The combinating tumbler 20 includes a first side wall 22, which side wall 22 includes a combinating tumbler retaining detent 24. The combinating tumbler 20 includes a second side wall 26 which includes a spring lever or biasing arm 28. The combinating tumbler 20 also includes a conventional key slot 30.

The plug 10 includes the individual combinating tumbler slots 16 into which the combinating tumbler 20 is press fit and retained. The slot 16 includes a pair of front walls (not illustrated) and a pair of rear walls 32, 34, which retain and prevent the combinating tumbler 20 from moving longitudinally in the plug 10. An opening 36 between the walls 32, 34 mates with the slot 30 to provide a passageway for the key.

The slot 16 includes a first side wall 38, which terminates in a combinating tumbler retaining edge or offset 40. The slot 16 includes a second side wall 42, which terminates in a spring retaining ledge 44. In assembling the plug 10, a biasing spring 46 is first inserted into the slot 16, bearing at one end against the retaining ledge 44. The combinating tumbler 20 then is inserted into the slot 16 with the arm 28 bearing against the opposite end of the spring 46. The combinating tumbler 20 then is forced into the slot 16 at only a slight angle by pressing downwardly as shown by an arrow 48 and laterally as shown by an arrow 50.

The side wall 26 bears against a slot wall 52 formed adjacent the ledge 44. This forces the detent 24 against the side wall 38. One of several things can happen in this assembly operation. The detent 24 can be crimped or burred by the side wall 38. A corner 54 between the side wall 38 and the offset 40 can be burred or broken off. Alternately, both crimping and burring can occur.

If burring occurs, the combinating tumbler 20 can jam and not be operable between the locked position (FIG. 2*b*) and the retracted or unlocked position (not illustrated). Alternatively, the key may be able to move the combinating tumbler to the unlocked position, but the spring 46 may not have sufficient biasing force to return the combinating tumbler 20 to the locked position. If the corner 54 or portion thereof or of the detent 24 breaks off, the loose piece also can jam the plug, making the lock partially or totally inoperable. If the corner 54 is broken off or if the detent 24 is sufficiently broken off or crimped, the detent 24 can pass over the corner 54 and again cause jamming or faulty operation of the lock.

Figure 3A:
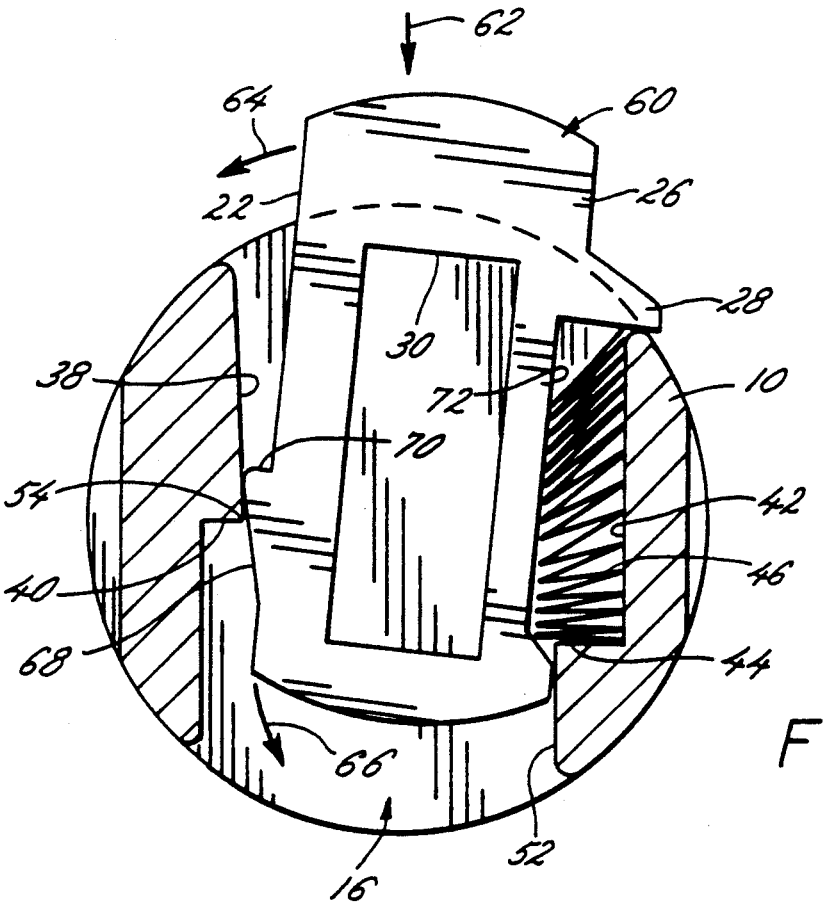
FIGS 3*a* and 3*b* are cross-sectional views of the combinating tumbler assembly of the present invention in the lock, also shown in and taken along the line 2—2 in FIG. 1.
Figure 3B:
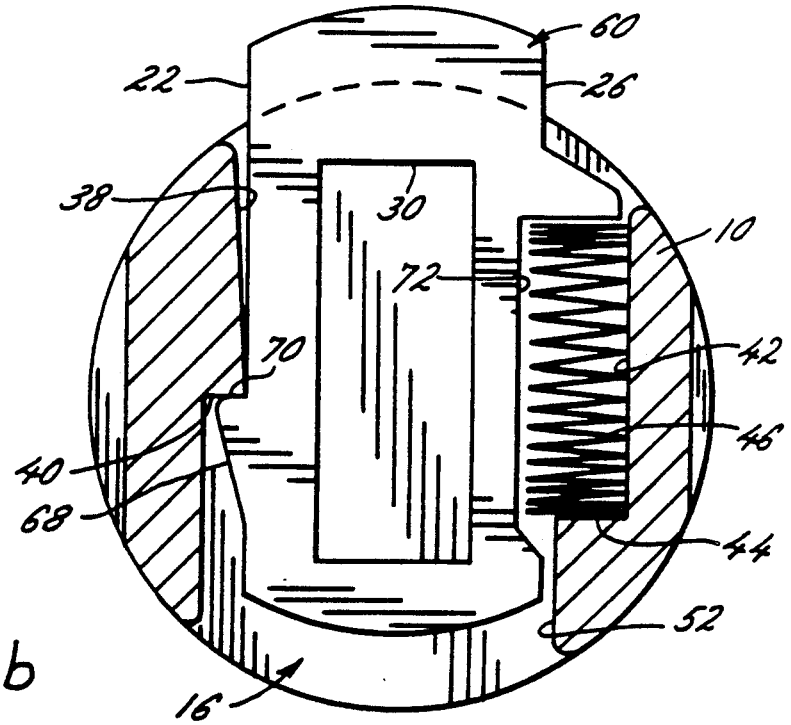

To avoid these problems, a snap-in self holding combinating tumbler of the present invention has been developed as shown in FIGS. 3*a* and 3*b*, generally indicated by the reference number 60. The same numerals have been utilized for the same or equivalent elements as those previously described. Also, in FIGS. 3*a* and 3*b*, the details of the plug rear walls and key opening are not illustrated.

In assembling the plug 10, with the snap-in self holding combinating tumbler 60, the operation is similar to the prior art assembly. However, the combinating tumbler 60 is configured to snap into the plug 10, without any substantial physical damage to the plug 10 or the combinating tumbler 60. This is accomplished by the improved structural design of the combinating tumbler 60.

As before, during assembly, the combinating tumbler 60 is pressed downwardly into the slot 16 as illustrated by an arrow 62. The combinating tumbler 60 is first tilted and then rotated to snap into the plug 10 as illustrated by the arrows 64 and 66.

In the first portion of the assembly, the combinating tumbler 60 includes a ramp or bearing surface 68 which bears against the slot side wall 38. The ramp 68 terminates in a retaining detent 70, having a function substantially identical to the detent 24. The ramp 68 and detent 70 are not crimped and do not burr the slot side wall 38 or the corner 54, since the combinating tumbler 60 includes a spring relief recess 72 in the combinating tumbler side wall 26. The spring relief recess 72 provides a space to accommodate the spring 46, allowing the combinating tumbler 60 to tilt against the spring 46. Further, the spring 46 and the side wall 52 are dimensioned such that the spring 46 extends into the slot 16. The spring 46 also laterally collapses from the insertion pressure against the spring relief recess 72 to further provide clearance for the insertion of the combinating tumbler 60.

When the ramp 68 and detent 70 reach the corner 54, the combinating tumbler 60 snaps into the offset 40. At the same time the biasing force of the spring 46 maintains the combinating tumbler 60 in an upright operating position in the slot 16. When or if, the combinating tumbler 60 is to be removed, the opposite operation can occur to release the combinating tumbler 60 from the slot 16 and hence the plug 10.

The improved combinating tumbler 60 is easy to replace, when desired, however, the combinating tumbler 60 also has broad applicability in all plug type locks. This is because the snap-in assembly requires less insertion force which results in no substantial physical damage and hence an easily operable lock which does not bind or jam.

What is claimed and desired to be secured by Letters Patent of the United States is:

1. A plug for use in a combinating tumbler lock, said plug comprising:

a plurality of combinating tumbler slots, each combinating tumbler slot including means for bearing against combinating tumbler biasing means in a first wall thereof and combinating tumbler retaining means in a second wall thereof;

each combinating tumbler configured to include means for bearing against the combinating tumbler biasing means in a first wall thereof and an upwardly and outwardly extending ramp from said second combinating tumbler wall which terminates in a detent projecting back into said combinating tumbler wall for bearing against said combinating tumbler retaining means; and said combinating tumbler configured to be snap-fit into and retained in said combinating tumbler slot without significant physical damage to the structure of said combinating tumbler or said slot, said snap-fit configuration includes a recess in the first combinating tumbler wall and said ramped detent in said second combinating tumbler wall such that said recess and said ramped detent interact to allow said combinating tumbler to rotationally pivot within said combinating tumbler slot upon insertion into said combinating tumbler slot.

2. The plug as defined in claim 1 wherein said combinating tumblers are configured to be removed from said combinating tumbler slots and replaced to change the key bitting of said plug.

3. The plug as defined in claim 1 wherein said combinating tumbler biasing means include a spring bearing against both said slot bearing means and said combinating tumbler bearing means.

4. The plug as defined in claim 3 wherein said slot bearing means include a ledge formed in said first slot wall and said combinating tumbler biasing bearing means include an arm extending from said first combinating tumbler wall.

5. The plug as defined in claim 4 wherein said recess in said first combinating tumbler wall is a spring relief wall recess.

6. The plug as defined in claim 1 wherein said combinating tumbler retaining means include a retaining offset in said second slot wall.

7. The plug as defined in claim 1 wherein said combinating tumbler biasing means include a spring bearing against both said slot bearing means and said combinating tumbler bearing means;

said slot bearing means include a ledge formed in said first slot wall and said combinating tumbler biasing bearing means include an arm extending from said first combinating tumbler wall;

said combinating tumbler retaining means include a retaining offset in said second slot wall; and said second slot wall is slightly angled back from vertical above said retaining offset.

8. The plug as defined in claim 7 wherein said recess in said first combinating tumbler wall is a spring relief wall recess.

9. An improved combinating tumbler lock, said lock including a lock shell and a plug insertable in the shell, said improvement comprising:

the plug including a plurality of combinating tumbler slots, each combinating tumbler slot including means for bearing against combinating tumbler biasing means in a first wall thereof and combinating tumbler retaining means in a second wall thereof;

each combinating tumbler to include means for bearing against the combinating tumbler biasing means in a first wall thereof and an upwardly and outwardly extending ramp from said second combinating tumbler wall which terminates in a detent projecting back into said combinating tumbler wall for bearing against said combinating tumbler retaining means; and said combinating tumbler configured to be snap-fit into and retained in said combinating tumbler slot without significant physical damage to the structure of said combinating tumbler or said slot, said snap-fit configuration includes a recess in the first combinating tumbler wall and said ramped detent in said second combinating tumbler wall such that recess and said ramped detent interact to allow said combinating tumbler to rotationally pivot within said combinating tumbler slot upon insertion into said combinating tumbler slot.

10. The lock as defined in claim 9 wherein said plug is removable from the lock shell and said combinating tumblers are configured to be removed from said combinating tumbler slots and replaced to change the key bitting of said plug.

11. The plug as defined in claim 9 wherein said combinating tumbler biasing means include a spring bearing against both said slot bearing means and said combinating tumbler bearing means.

12. The plug as defined in claim 11 wherein said slot bearing means include a ledge formed in said first wall slot and said combinating tumbler biasing bearing means include an arm extending from said first combinating tumbler wall.

13. The plug as defined in claim 12 wherein said recess in said first combinating tumbler wall is a spring relief wall recess.

14. The plug as defined in claim 9 wherein said combinating tumbler retaining means include a retaining offset in said second slot wall.

15. The plug as defined in claim 9 wherein said combinating tumbler biasing means include a spring bearing against both said slot bearing means and said combinating tumbler bearing means;

said slot bearing means include a ledge formed in said first slot wall and said combinating tumbler biasing bearing means include an arm extending from said first combinating tumbler wall;

said combinating tumbler retaining means include a retaining offset in said second slot wall; and said second slot wall is slightly angled back from vertical above said retaining offset.

16. The plug as defined in claim 15 wherein said recess in said first combinating tumbler wall is a spring relief wall recess.

* * * * *